US008963662B2

(12) United States Patent
Asokan et al.

(10) Patent No.: US 8,963,662 B2
(45) Date of Patent: Feb. 24, 2015

(54) ARC CHUTELESS DC CURRENT INTERRUPTOR

(71) Applicant: General Electric Company, Schenectady, NY (US)

(72) Inventors: Thangavelu Asokan, Bangalore (IN); Nalini Nanrudaiyan, Bangalore (IN)

(73) Assignee: General Electric Company, Schenectady, NY (US)

( * ) Notice: Subject to any disclaimer, the term of this patent is extended or adjusted under 35 U.S.C. 154(b) by 190 days.

(21) Appl. No.: 13/781,940

(22) Filed: Mar. 1, 2013

(65) Prior Publication Data

US 2013/0228551 A1 Sep. 5, 2013

(30) Foreign Application Priority Data

Mar. 5, 2012 (IN) ..... 815/CHE/2012

(51) Int. Cl.
*H01H 33/18* (2006.01)
*H01H 9/44* (2006.01)

(52) U.S. Cl.
CPC ..... *H01H 33/182* (2013.01); *H01H 9/443* (2013.01)
USPC ..... 335/147; 335/16; 335/202

(58) Field of Classification Search
USPC ..... 335/147, 16, 202
See application file for complete search history.

(56) References Cited

U.S. PATENT DOCUMENTS 4,367,448 A 1/1983 Nishizako
4,680,562 A * 7/1987 Bratkowski et al. ..... 335/16
4,757,294 A * 7/1988 Todaro et al. ..... 335/202
4,809,132 A * 2/1989 Palmieri et al. ..... 361/634
4,962,406 A 10/1990 Walker et al.
5,004,874 A 4/1991 Theisen et al.
5,835,319 A 11/1998 Welles, II et al.
6,809,282 B2 10/2004 Fasano
7,126,445 B1 10/2006 McMahon et al.
7,915,985 B2 3/2011 Schmitz et al.
8,816,801 B2 * 8/2014 Tachikawa et al. ..... 335/147
2004/0051605 A1 3/2004 Fasano
2007/0273461 A1 11/2007 Kang et al.
2010/0072174 A1 3/2010 Asokan et al.
2013/0335175 A1 * 12/2013 Tachikawa et al. ..... 335/147

OTHER PUBLICATIONS

Hall et al., "Application of Rotating Arc SF6 Interrupter Design to the Highest Distribution Voltage Levels", Fifth International Conference on Trends in Distribution Switchgear: 400V-145kV for Utilities and Private Networks, pp. 145-148, Nov. 10-12, 1998.
"System pro M Compact Miniature Circuit Breakers S200, S200P, S200U, S200UP", System pro M S200 Series.
Search Report and Written Opinion from EP Application No. 13157755.3 dated Jun. 19, 2013.

* cited by examiner

*Primary Examiner* — Truc Nguyen
(74) *Attorney, Agent, or Firm* — GE Global Patent Operation; Stephen G. Midgley

(57) ABSTRACT

A system comprising a circuit interrupter configured to interrupt flow of current through a circuit during an over current condition, wherein the circuit interrupter comprises two contacts configured to remain in contact when a current flowing through the two contacts is less than a threshold value, a tripping mechanism configured to separate the two contacts when the current equals or exceeds the threshold value, and at least one of either a permanent magnet or an electrode configured to extinguish an electric arc formed between the two contacts of the circuit interrupter when the two contacts are separated, wherein the circuit interrupter does not include an arc chute.

20 Claims, 14 Drawing Sheets

ARC CHUTELESS DC CURRENT INTERRUPTOR

BACKGROUND OF THE INVENTION

Embodiments of the present invention relate to circuit interrupters and, more specifically, to extinguishing an arc in a circuit interrupter.

An electrical distribution system, such as an electrical grid, may be used to distribute electricity over a region to various facilities or within a facility to various equipment. The distributed electricity may be used to power large-scale and small-scale circuits. Occasionally, in such circuits, an over-current condition such as a short circuit may occur due to degradation of circuit elements, operator error, environmental disturbances, and the like. In order to minimize the damage caused by an over-current condition, a circuit interrupter or circuit breaker may be used. The circuit interrupter generally includes a pair of contacts which, under normal operating conditions, remains closed, allowing current to flow through the circuit. The circuit interrupter is generally configured to detect an over-current condition in the circuit, such as a fault or short circuit. Upon detecting such an over-current condition, the circuit interrupter may trip (open or disconnect the contacts) and the circuit is disconnected.

In some electrical distribution systems, such as DC distribution systems, an electric arc may form between the separated contacts of the circuit interrupter during separation. The electric arc may cause damage to the contacts of the circuit interrupter, shortening their operational life.

Therefore, an arc chute may be included in a circuit interrupter to gradually extinguish the electric arc after separation of the circuit interrupter contacts. Arc chutes generally include structures that stretch an arc by making the arc wrap around arc dividers, such as steel plates. However, such a circuit interrupter employing such an arc extinguishing structure may not be an efficient means of extinguishing electric arcs formed in a DC circuit, as DC current is constant and does not pass a zero point like an AC system does. Thus, a circuit interrupter capable of efficiently extinguishing an electric arc in a DC system is needed.

BRIEF SUMMARY OF THE INVENTION

In an embodiment, a system includes a circuit interrupter configured to interrupt flow of current through a circuit upon a predetermined condition, in which the circuit interrupter does not include an arc chute, but rather includes at least one of either a permanent magnet or an electrode. The permanent magnet or electrode is disposed about the circuit interrupter and configured to generate a magnetic field, an electric field, or both, respectively. The magnetic field, electric field, or both, is configured to extinguish an electric arc formed between two contacts of the circuit interrupter.

In an embodiment, a system includes a circuit interrupter configured to interrupt flow of current through a circuit upon a predetermined condition, in which the circuit interrupter does not have an arc chute, but rather includes a permanent magnet disposed about the circuit interrupter configured to generate a magnetic field, in which the magnetic field is configured to stretch an electric arc formed between two contacts of the circuit interrupter, as well as an electrode disposed about the circuit interrupter configured to generate an electric field, in which the electric field is configured to extinguish the electric arc formed between the two contacts of the circuit interrupter.

In an embodiment, a circuit interrupter configured to interrupt flow of current through a circuit upon a predetermined condition, in which the circuit interrupter does not include an arc chute.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF EXEMPLARY EMBODIMENTS OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

Figure 1:
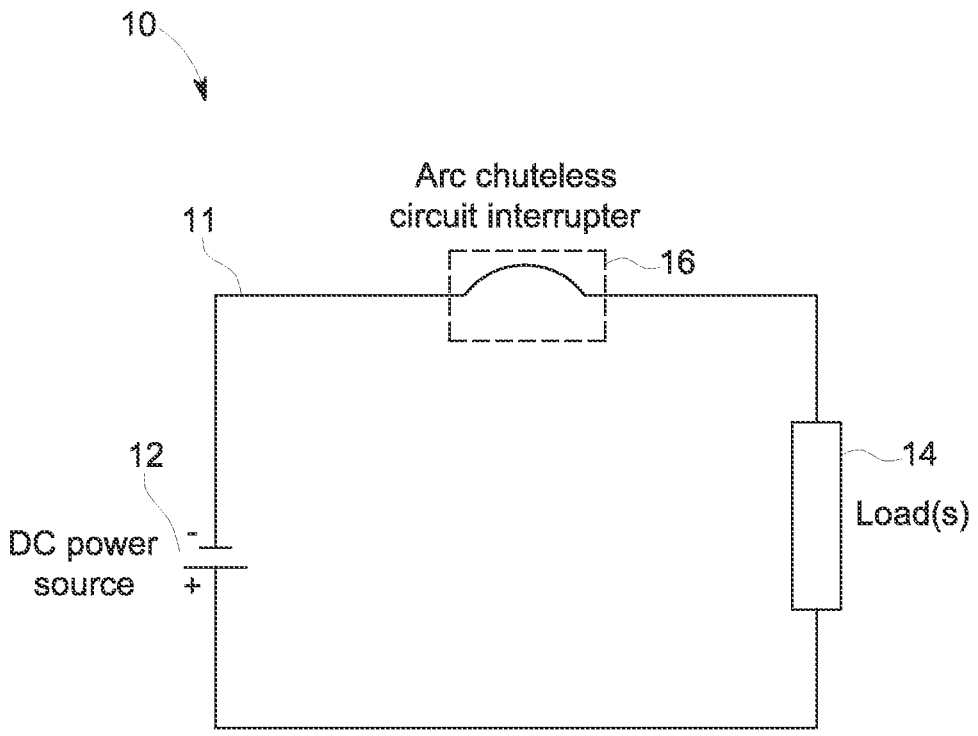
FIG. 1 illustrates a simple circuit diagram of an electrical system using an arc chuteless circuit interrupter in accordance with an embodiment of the present invention.

Turning now to FIG. 1, embodiments of the present invention consist of an electrical system 10 having an electrical circuit 11 defined by a power source 12, a load 14, and a circuit interrupter that does not include an arc chute, i.e., an arc chuteless circuit interrupter 16. In an embodiment, the power source 12 includes a DC power source, such as a DC power distribution bus or DC power grid, which supplies DC power to the circuit 11. The load 14 may include one or more power consuming devices and/or circuits such as equipment, controllers, and so forth. The arc chuteless circuit interrupter 16 may be used to protect the circuit 11 and the load 14 from being damaged should an over-current condition, such as a short circuit, occur.

During normal operation (i.e., no over-current), the power source 12 supplies power to the load 14. The circuit 11 is completed via a pair of closed contacts in the arc chuteless circuit interrupter 16. However, when an over-current condition is detected, the contacts are automatically opened. Thus, the circuit 11 and the load 14 are disconnected from the power supply 12, and generally protected from the effects of an over-current.

Figure 2:
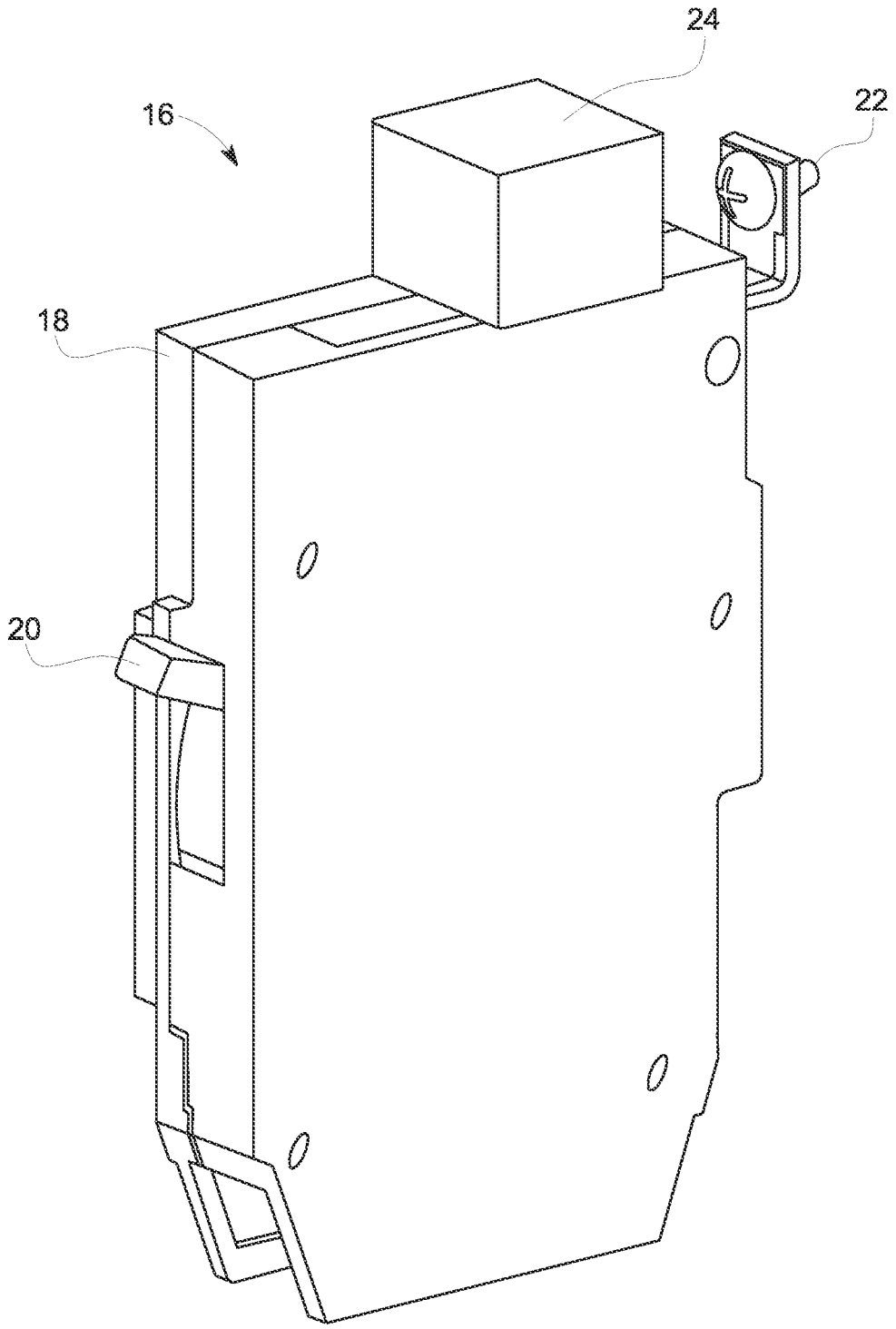
FIG. 2 is a perspective view of an arc chuteless circuit interrupter with one permanent magnet in accordance with an embodiment of the present invention.
Figure 3:
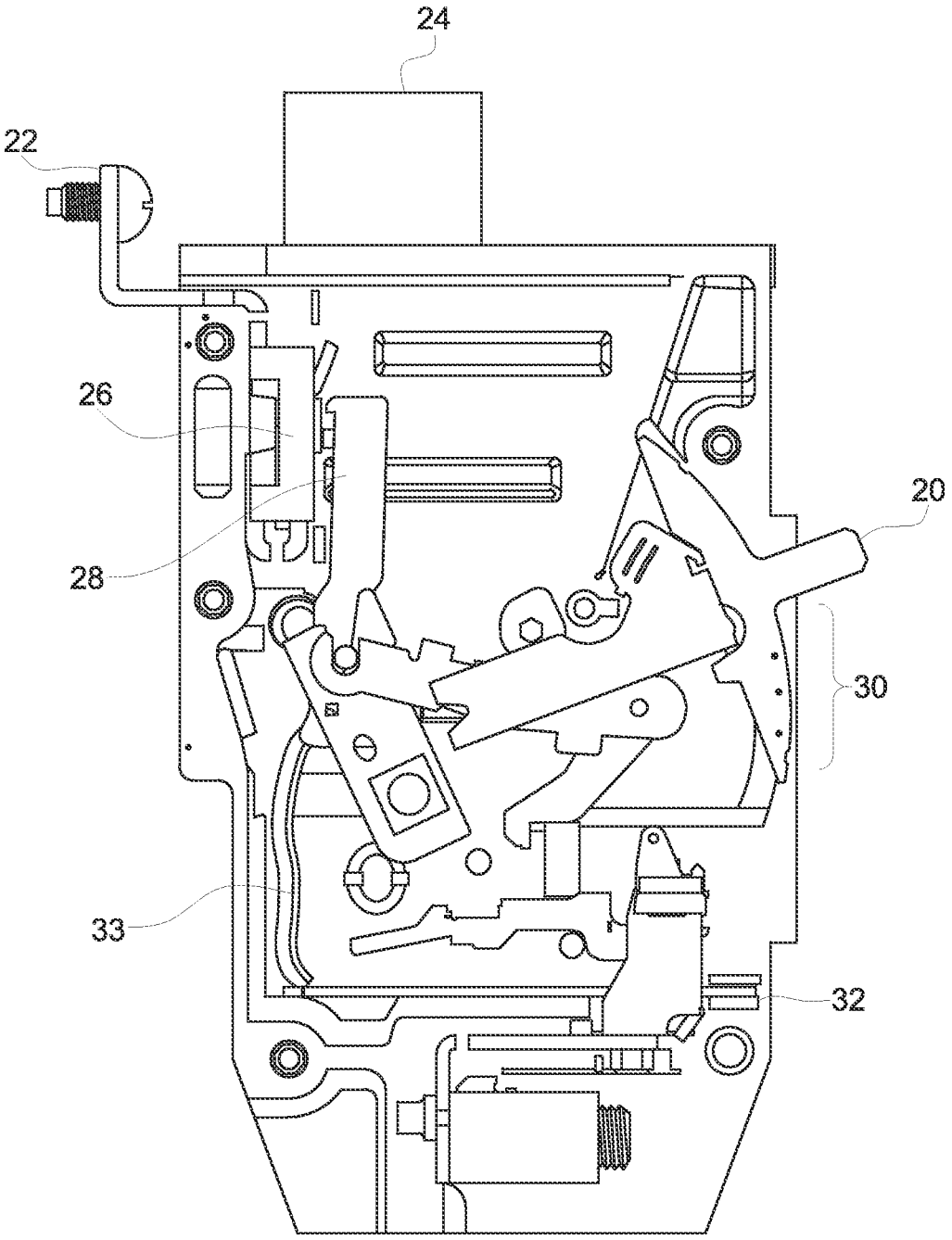
FIG. 3 is a view of the arc chuteless circuit interrupter with one permanent magnet showing its internal functional components, in accordance with an embodiment of the present invention.

A perspective view of an embodiment of an arc chuteless circuit interrupter 16 is depicted in FIG. 2. In the illustrated embodiment, the arc chuteless circuit interrupter 16 includes a housing 18, a switch 20, an external terminal 22, and a permanent magnet 24 disposed on one surface of the arc chuteless circuit interrupter 16. FIG. 3 provides an internal view of the depicted embodiment of the arc chuteless circuit interrupter 16 of FIG. 2, which further includes a stationary contactor 26 which is conductively coupled to the external terminal 22, a moveable contactor 28 shown in a closed, normal operating position, a tripping mechanism 30, and a bimetallic strip 32.

The bimetallic strip 32 may be made of two strips of dissimilar metals jointed or bonded together in layers, and the two dissimilar metals generally expand differently in response to the same amount of heat. Thus, when the bimetallic strip 32 is heated, it may bend or curl in a certain manner. In certain embodiments, the bimetal strip 32 may be electrically coupled to a load terminal by a conductive wire, as well as to the moveable contactor 28 via a contact arm 33. During normal operation, the moveable contact 28 and the stationary contact 22 are closed, and current flows from the power source 12 to the load, to the bimetallic strip to the closed contacts 26, 28, to the external terminal 22, and back to the power source 12 or ground.

When an over-current occurs, the bimetallic strip 32 rapidly increases in temperature, causing it to bend. The bimetallic strip 32 may be configured to flex when it reaches the temperature associated with an over-current event. In an embodiment, as illustrated in FIG. 3, when an over-current event occurs, the bimetallic strip 31 flexes and pushes the contact arm 31, which is connected to moveable contact 28 and the tripping mechanism 30. The tripping mechanism includes a spring that is "loaded" during normal operation. However, during an over-current event, the pushing motion of the contact arm 31 releases the spring, which separates the moveable contact 28 from the stationary contact 26. As such, the circuit 11 is opened and disconnected from the power source 12. Generally, the actions described above take place in rapid succession so as to disengage the circuit 11 from the power source as quickly as possible, which minimizes or eliminates damage to the circuit 11 and load 14.

It should be noted that although the illustrated embodiment of the arc chuteless circuit interrupter 16 includes a bimetallic strip as an over-current detection and tripping mechanism, a variety of over-current detection and tripping mechanisms may be used. This includes, but is not limited to, an electromagnetic detection and tripping mechanism.

When the moveable contact 28 and the stationary contact 26 separate from each other during an over-current event, the air in between the contacts 26, 28 becomes ionized, and an electric arc may form. The electric arc generally only extinguishes when its impedance is high enough to stop current flow. In the present embodiment, the permanent magnet 24 generates or provides a magnetic field that stretches the arc formed between the contacts 26, 28. The magnetic field may push or pull the arc, depending on the pole of the permanent magnet facing the arc. The pushing or pulling effect of the magnetic field has a stretching effect on the arc, causing it to lengthen. As the arc lengthens, its impedance increases, and current flow decreases, relieving the circuit of the intense heat and pressure conditions associated with an over-current event. The lengthening of the arc further increases the arc voltage. Specifically, in DC systems, when the arc voltage is greater than the power source voltage, the arc generally extinguishes. It should be noted that the arc chuteless circuit interrupter 16 does not include an arc chute structure or an arc chute equivalent structure.

Figure 4:
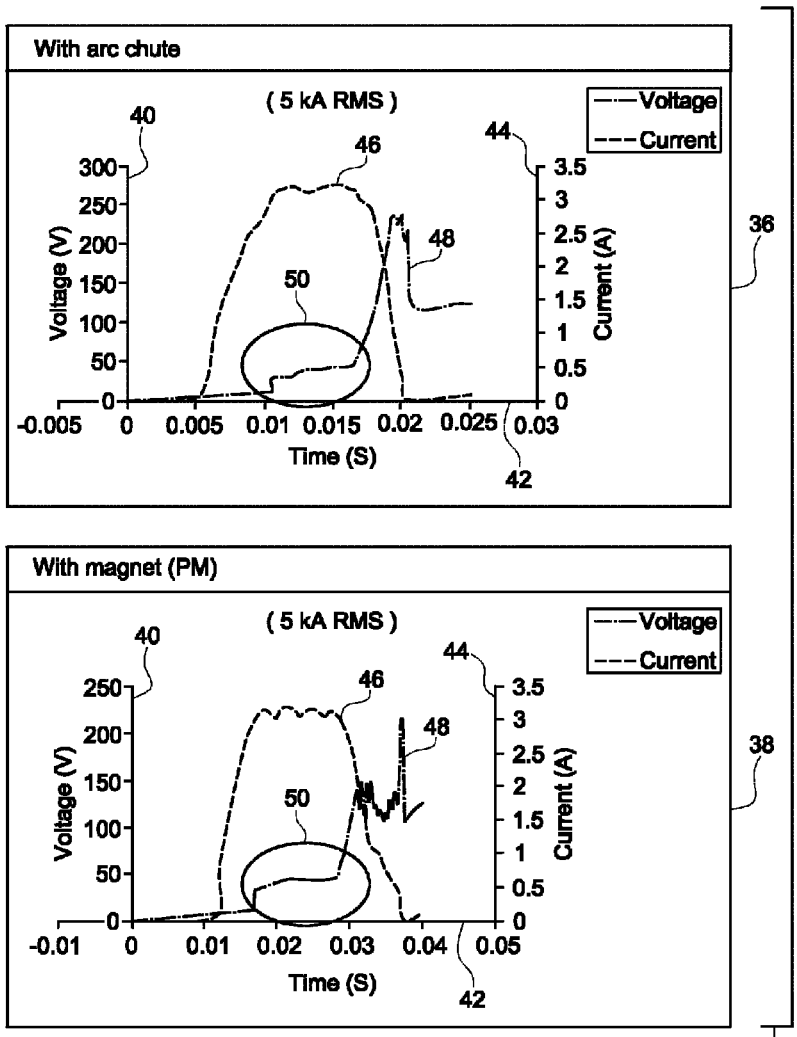
FIG. 4 illustrates a pair of graphs comparing performance of the arc chuteless circuit interrupter according to an embodiment of the present invention with one permanent magnet to that of a traditional arc chute circuit interrupter.

The effectiveness of the arc chuteless circuit interrupter 16 with one permanent magnet is quantified in the graphs of FIG. 4. FIG. 4 includes a pair of graphs 36, 38 comparing the performance of the arc chuteless circuit interrupter with one permanent magnet (graph 38) to the performance of a circuit interrupter that includes an arc chute (graph 36) during an over-current event. Both graphs include a voltage axis 40, a time axis 42, and a current axis 44. Both graphs also include a current line 46 and a voltage 48, such that the current and voltage characteristics of the circuit during an over-current event can be illustrated. As shown, the rise in the current line 46 indicates the rise in current that occurs when the over-current event occurs. Shortly after, the circuit interrupters trip, indicated by a slight rise 50 in the voltage lines. The continued rise in the voltage lines indicates the arc extinguishing efforts of the circuit interrupters, respectively. The graphs 36, 38 also show that the current lines 46 drop as the voltage lines 48 rise, indicating relief from over-current conditions. In comparing the two graphs 36, 38, it can be seen that the rise in voltage (and drop in current) of the arc chuteless circuit interrupter (graph 38) is generally comparable to that of the traditional arc chute circuit interrupter (graph 36). Thus, such an embodiment of the arc chuteless circuit interrupter may be deemed at least as efficient as the traditional arc chute circuit interrupter.

Figure 5:
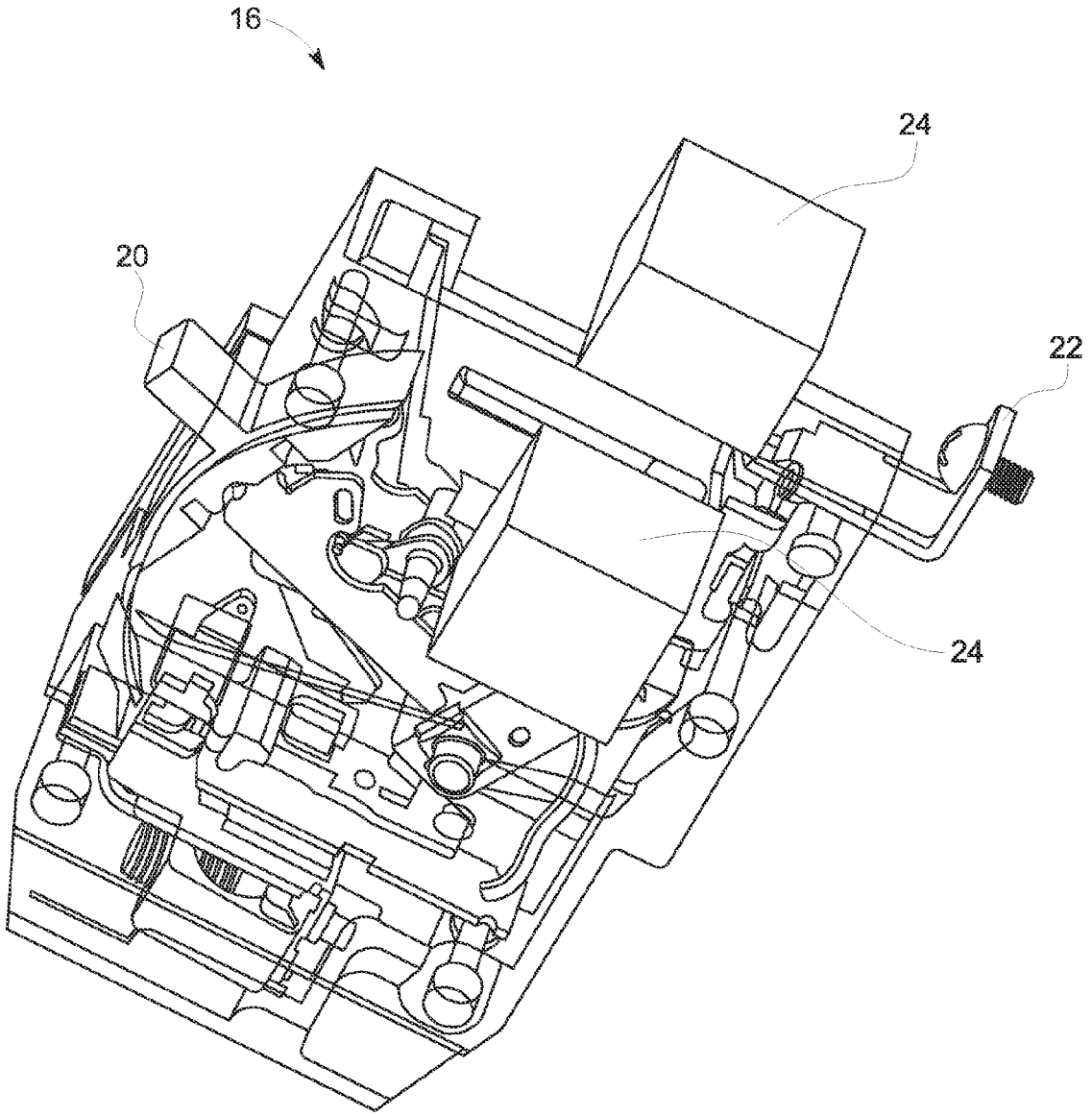
FIG. 5 is a perspective view of an arc chuteless circuit interrupter with two permanent magnets in accordance with an embodiment of the present invention.

FIG. 5 illustrates an embodiment of the arc chuteless circuit interrupter 16. As depicted, the arc chuteless circuit interrupter 16 of FIG. 5 includes two permanent magnets 24. In this embodiment, the two permanent magnets 24 are configured to simultaneously push and pull the arc in a same direction, further stretching the arc. That is, the poles of the magnets 24 are arranged such that a first magnet pushes the arc in a first direction while the second magnet pulls the arc in the same direction. For example, the two magnets may be configured such that one magnet 24 is positioned such that its north pole faces the arc, and the other magnet 24 is positioned such that its south pole faces the arc, and the two magnets 24 are disposed on opposite sides of the arc. In this manner, both magnets act to stretch and lengthen the arc in a given direction.

Figure 6:
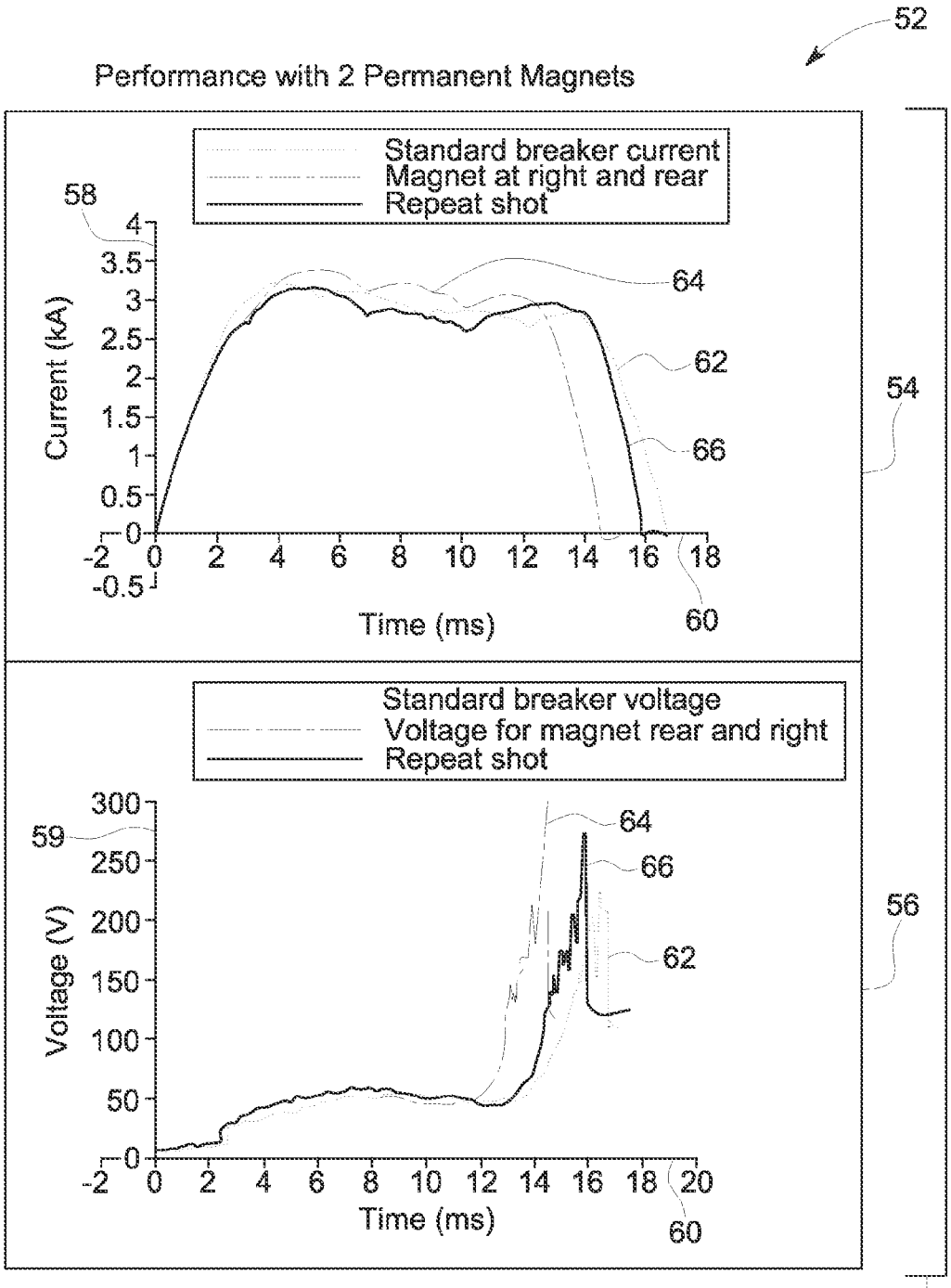
FIG. 6 illustrates a pair of graphs comparing performance of the arc chuteless circuit interrupter according to an embodiment of the present invention with two permanent magnets to that of a traditional arc chute circuit interrupter.

FIG. 6 includes a current graph 54 and a voltage graph 56, which are aimed at comparing the performance of the arc chuteless circuit interrupter 16 with two magnets against a circuit interrupter that includes an arc chute. The current graph 54 includes a current axis 58, which is represented in kiloamps, and a time axis 60, which is represented in milliseconds. The current graph 56 illustrates the amount of current flowing during an over-current event in which a circuit break is used. The current graph 54 includes a reference line 62, which represents the circuit interrupter that include arc chutes, and a two magnet line 64, which represents the arc chuteless circuit interrupter 16 with two magnets. Effectiveness of a circuit interrupter may generally be measured by how quickly the current goes to zero. As seen in the current graph 54, the two magnet line 64 drops off faster than the reference line 62 does, indicating that the electric arc is extinguished faster in the arc chuteless circuit interrupter 16 with two magnets. As such, the arc chuteless circuit interrupter 16 with two magnets may be deemed more effective than a circuit interrupter employing arc chutes.

Accordingly, the voltage graph 56, which includes a voltage axis 59, indicates that the arc chuteless circuit interrupter 16 with two magnets (line 64) brings the arc to a higher voltage, and in less time, than the traditional arc chute circuit interrupter (line 66) does.

Figure 7:
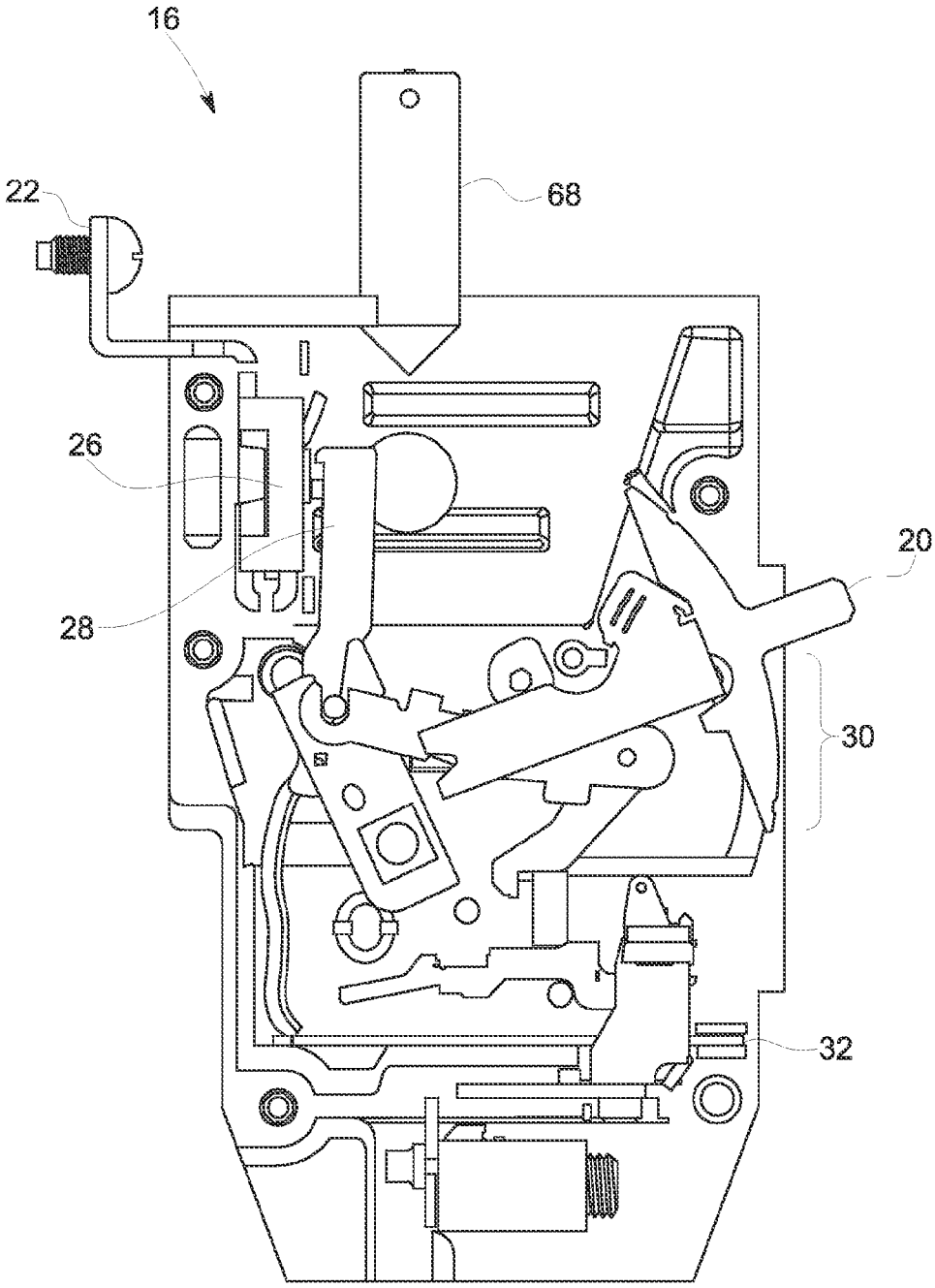
FIG. 7 and FIG. 8 illustrate an arc chuteless circuit interrupter having electrodes in two different positions, in accordance with aspects of the present invention.

FIG. 7 illustrates an embodiment of the arc chuteless circuit interrupter 16. The arc chuteless circuit interrupter 16 depicted here includes an electrode 68 instead of a permanent magnet. The electrode 68, when on, is configured to generate an electric field which influences the flow of electrons in the arc. Effectively, the electrode 68 pushes or pulls the arc, depending on the polarity of the electrode 68. Accordingly, the arc is stretched and lengthened, and eventually extinguished. The effective principle and function of electrode 68 is generally the same as that of the permanent magnet in the aforementioned embodiments. While the permanent magnet is always "on" (i.e., generating a field) by nature, the electrode 68 may be activated when the arc chuteless circuit interrupter 16 is tripped, as opposed to being always on. Specifically, when the arc chuteless circuit interrupter 16 trips, a voltage is applied to electrode. Various triggering techniques and internal or external voltage sources may be used to drive the electrode 68 and the electric field it generates.

Figure 8:
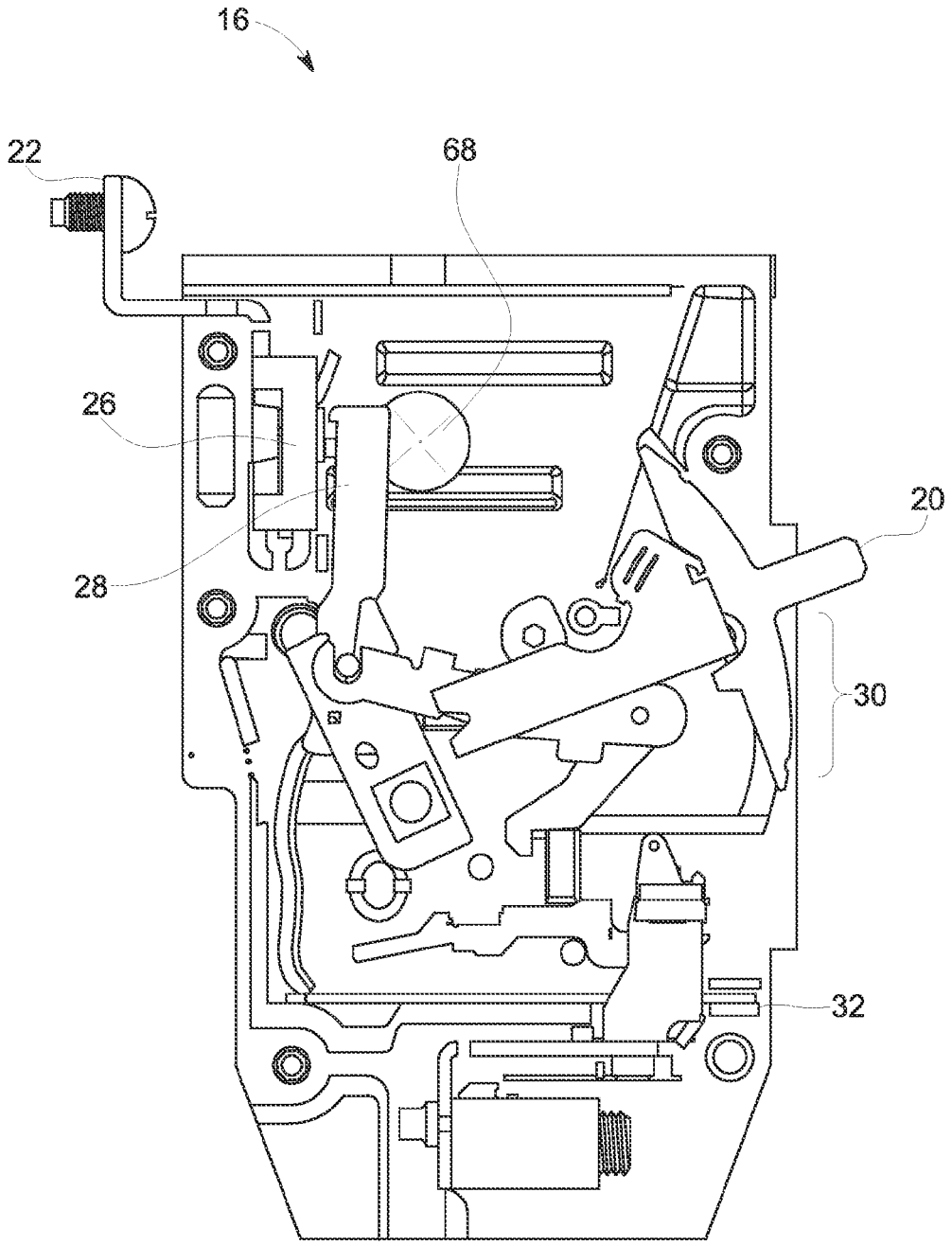

In the embodiment depicted in FIG. 7, the electrode 68 is disposed such that its tip enters the arc chuteless circuit interrupter 16 from the top. However, the electrode may be disposed in any effective position about the arc chuteless circuit interrupter 16. An example of another position is depicted in FIG. 8, in which the electrode 68 is disposed inward from a side of the arc chuteless circuit interrupter 16, as illustrated. In some embodiments, the arc chuteless circuit interrupter 16 may include more than one electrode 68, such as to effectively push and pull an arc, as discussed in the two magnet implementation above.

Figure 9:
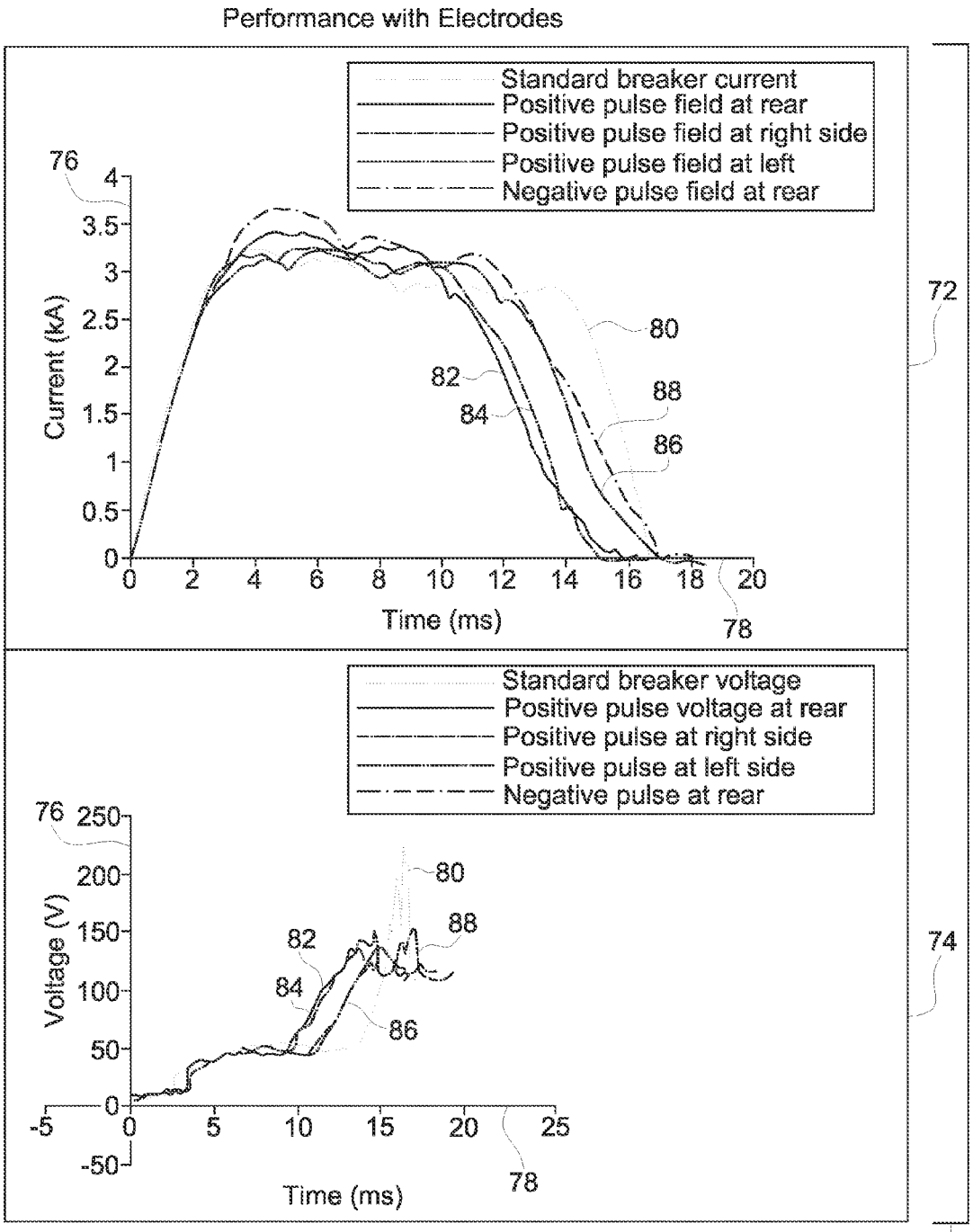
FIG. 9 illustrates a pair of graphs comparing performance of arc chuteless circuit interrupters according to an embodiment of the present invention having electrodes to that of a traditional arc chute circuit interrupter.

FIG. 9 includes a current graph 72 and a voltage graph 74, which are aimed at comparing the performance of the arc chuteless circuit interrupter 16 with the electrode 68 and a circuit interrupter employing arc chutes. The current graph 72 includes a current axis 76, which is represented in kiloamps, and a time axis 78, which is represented in milliseconds. The current graph 72 illustrates the amount of current flowing during an over-current event in which a circuit interrupter is used. The current graph 72 includes a reference line 80, which represents the circuit interrupter employing arc chutes, and four electrode lines 82, 84, 86, 88 which represent four combinations of electrode position and electrode polarity. As seen in the current graph 54, all four electrode lines 82, 84, 86, 88 drop off faster in current than the reference line 62 does.

Accordingly, the voltage graph 74, which includes a voltage axis 76, indicates that although the arc chuteless circuit interrupter 16 with electrode (lines 82, 84, 86, 88) doesn't appear to bring the arc to as high of a voltage than the circuit interrupter employing arch chutes does, the increased impedance and in increased voltage is enough to bring about the current drop illustrated in the current graph 72. As such, the arc chuteless circuit interrupter 16 employing electrodes may be deemed at least as or more effective than circuit interrupter employing arc chutes.

Figure 10:
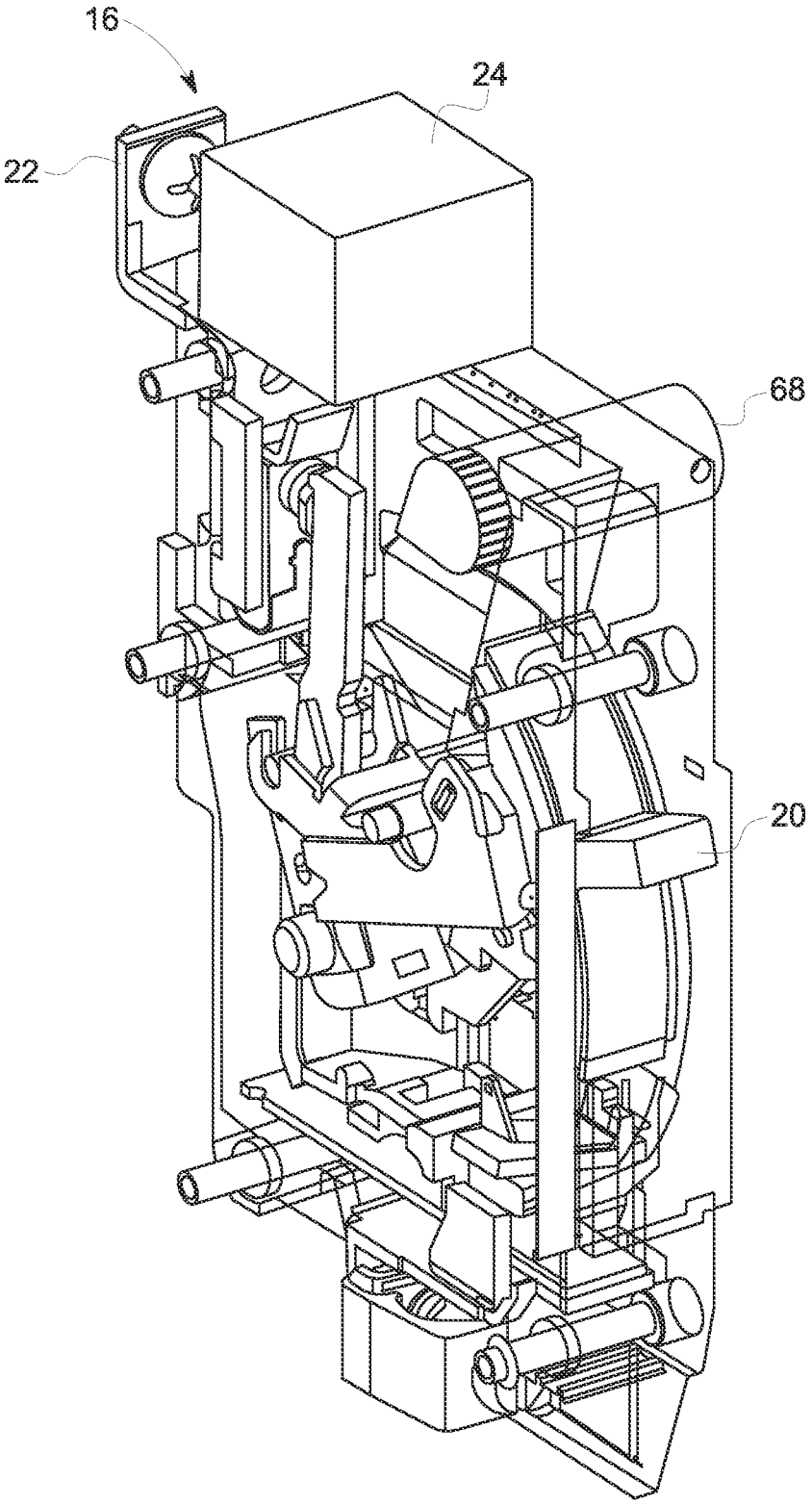
FIG. 10 and FIG. 11 illustrate an arc chuteless circuit interrupter having an electrode and a permanent magnet in two different positions, in accordance with an embodiment of the present invention.
Figure 11:
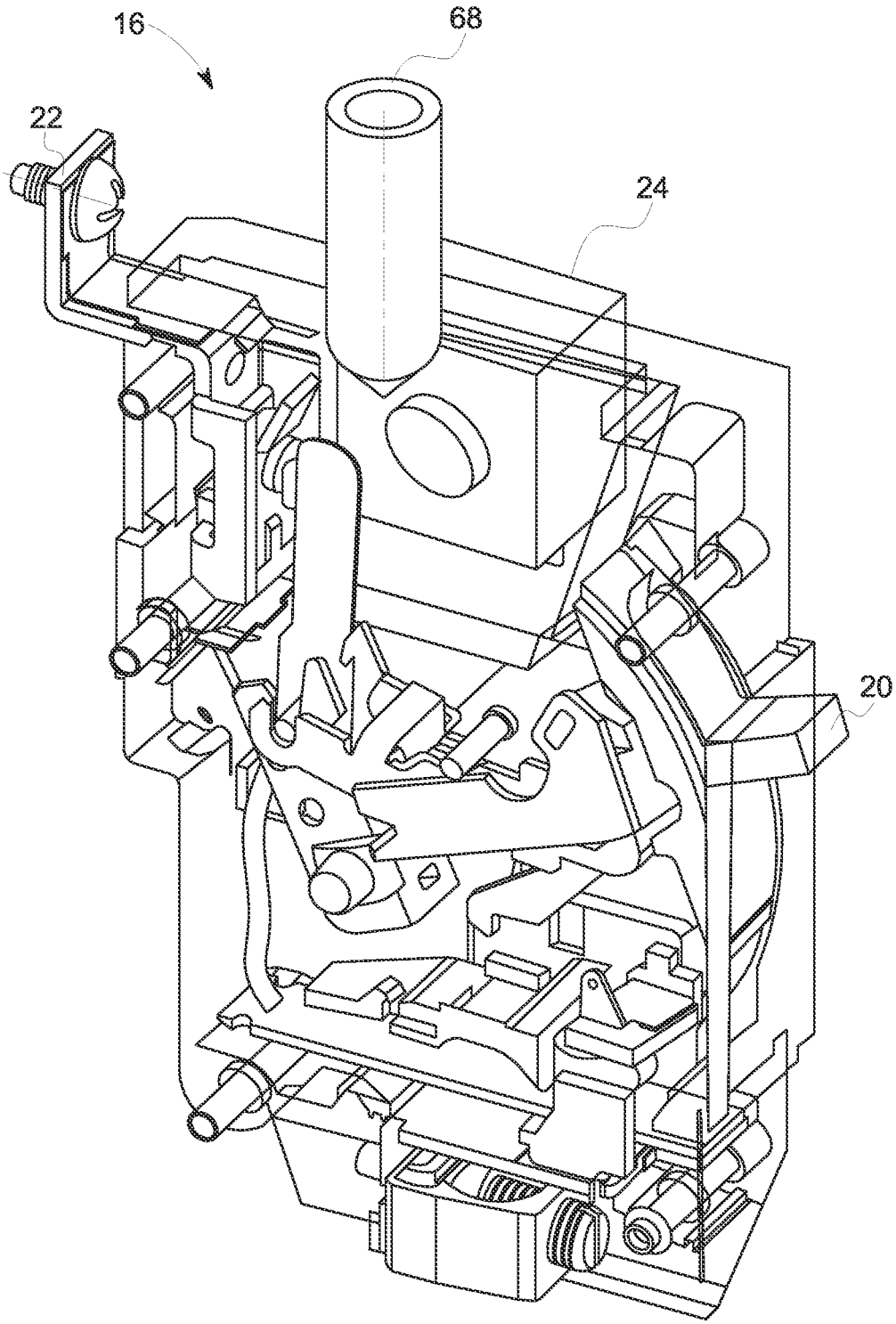

FIGS. 10 and 11 illustrate embodiments of the arc chuteless circuit interrupter 16 that include an electrode 68 and a permanent magnet 24. In these embodiments, the electrode 68 and the permanent magnet 24 are configured to generate electric and magnet fields, respectively, that push and pull the arc in a same direction, as discussed in the two magnets implementations herein. This stretches and lengthens the arc, which increases its impedance and voltage, causing the arc to become extinguished.

Figure 12:
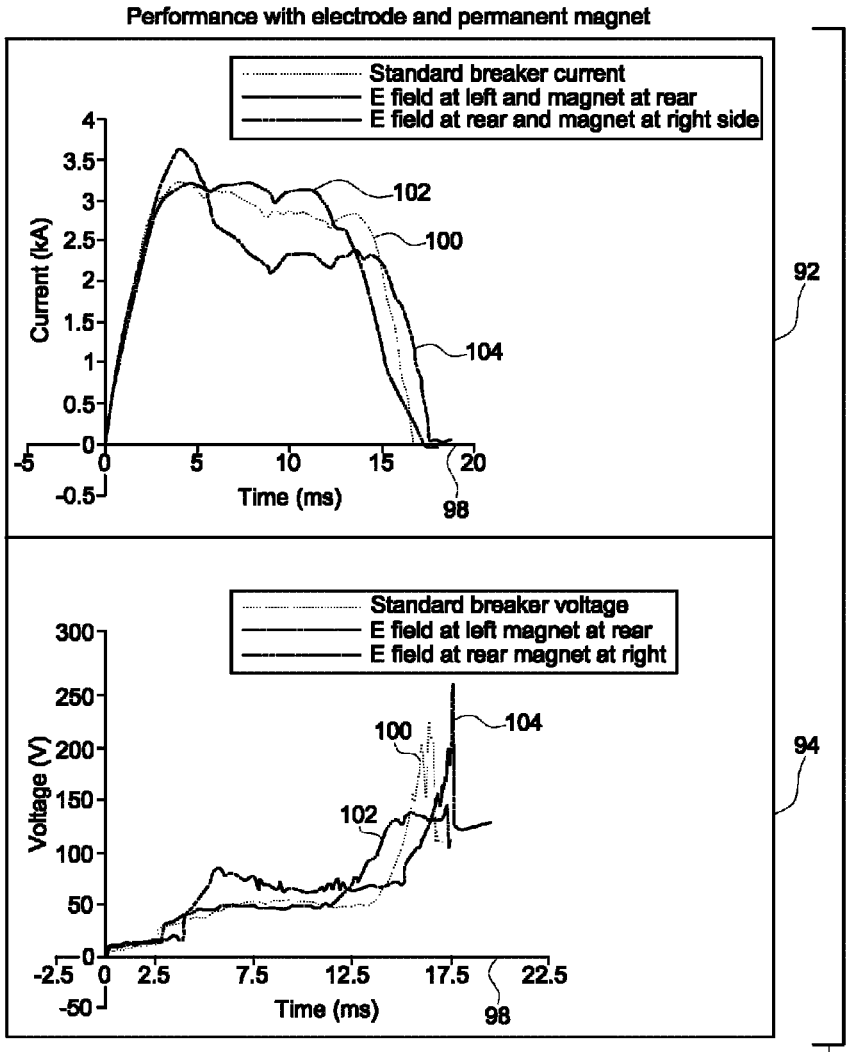
FIG. 12 is pair of graphs comparing performance of the arc chuteless circuit interrupter according to an embodiment of the present invention with an electrode and a permanent magnet to that of a traditional arc chute circuit interrupter.

FIG. 12 again includes a current graph 92 and a voltage graph 94, illustrating current and voltage characteristics during an over-current event in a circuit having circuit interrupters. Specifically, the graphs compare the current and voltage characteristics, respectively, between circuit interrupter employing arc chutes, represented by line 100, and two configurations of the arc chuteless circuit interrupter employing an electrode and permanent magnet, represented by lines 102, and 104. The graphs 92, 94 indicate that the circuit interrupter employing arc chutes (line 100) and the two configurations of the arc chuteless circuit interrupter with electrode and permanent magnet (lines 102, 104) are comparable in performance with respect to both current (graph 92) and voltage (graph 94). Thus, the arc chuteless circuit interrupter 16 with electrode and permanent magnet may be deemed at least as effective as circuit interrupter employing arc chutes.

The effectiveness of a circuit interrupter is largely indicated by how effectively (e.g., quickly) the arc is extinguished and circuit is protected. However, the operational life span of the circuit interrupter itself is also an important factor, as circuit interrupters are designed to be used in multiple over-current events. However, when an electric arc is established between open contactors 26, 28, the intense heat of the arc inflicts damage on the contacts 26, 28. Damage to the contactors 26, 28 causes the surface of the contacts 26, 28 to increase in resistance. If the resistance becomes too high, power may not be able to flow properly between the contacts 26, 28 when they are closed under normal operation. Thus, in an embodiment, it is advantageous for a circuit interrupter to incur less damage to the contactors 26, 28 when suppressing an over-current event.

Figure 13:
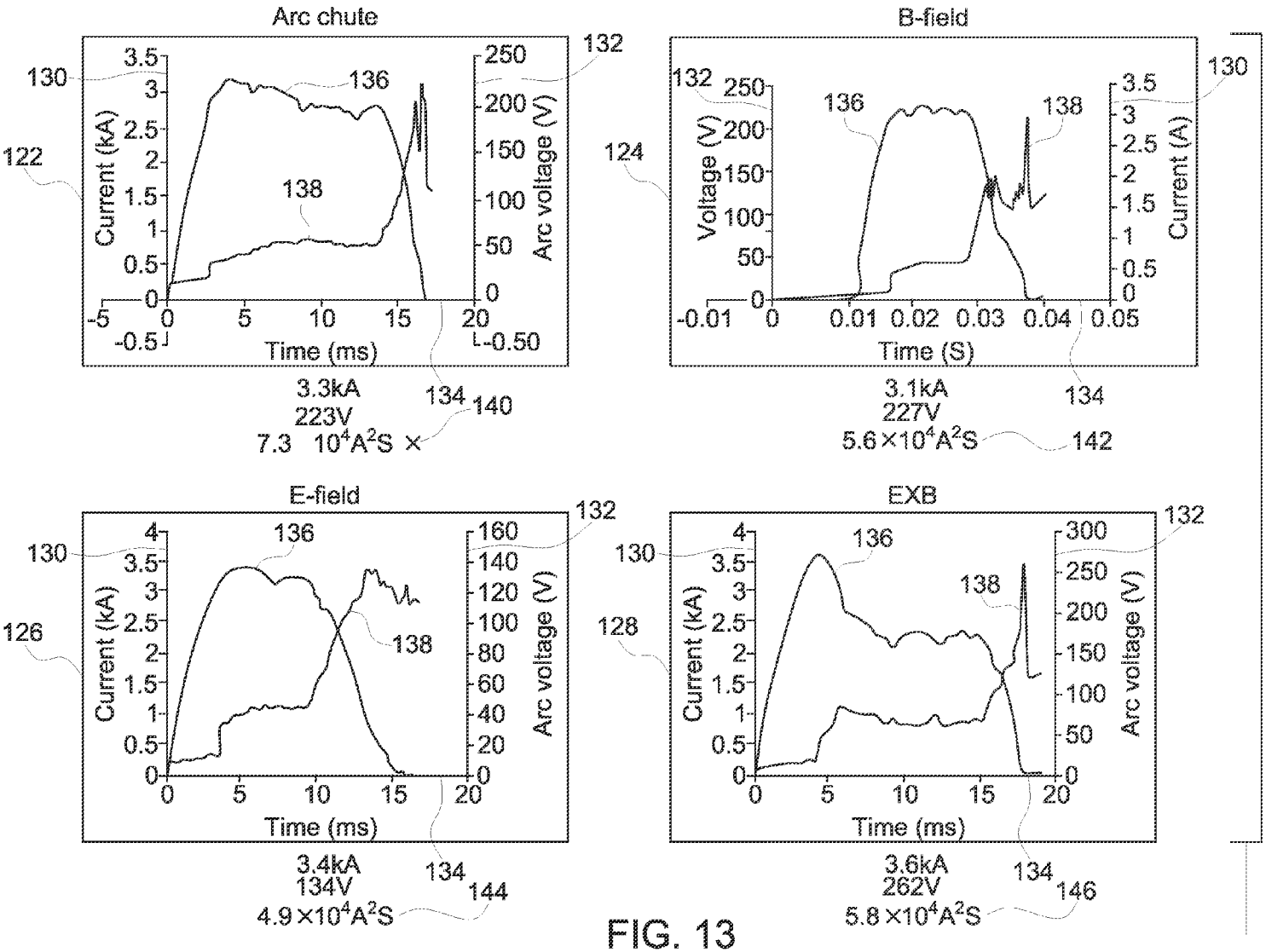
FIG. 13 is a graph comparing contact wear of contactor in arc chuteless circuit interrupters according to an embodiment of the present invention to that of a traditional arc chute circuit interrupter.

Let through energy is one measure of the damaging effect of over-current on a circuit interrupter. Generally, a lower let through energy indicates a more effective circuit interrupter. Let through energy is calculated as $I^2t$. Accordingly, lower current and shorter time attribute to a low let through energy. FIG. 13 illustrates current and voltage vs. time graphs of circuit interrupters with an arc chute 122, a permanent magnet 124, an electrode 126, and an electrode and a permanent magnet 128. Each graph is defined by a current axis 130, a voltage axis 132, and a time axis 134. Each graph also illustrates a current line 136 which indicates current with respect to time, and a voltage line 138 which indicates voltage with respect to time. Further, the respective let through energies of the four different circuit interrupter types 122, 124, 126, and 128 are shown. The circuit interrupter with arc chute 122 has an associated let through energy 140 of $7.3\times10^4A^2S$. The circuit interrupter with a permanent magnet 124 has an associated let through energy 142 of $5.6\times10^4A^2S$. The circuit interrupter with an electrode 126 has an associated let through energy 144 of $4.9\times10^4A^2S$, and the circuit interrupter with a permanent magnet and an electrode 128 has an associated let through energy 146 of $5.8\times10^4A^2S$. Thus, the let through energies of the three embodiments of the arc chuteless circuit interrupter 124, 126, and 128 all have lower let through energies than the circuit interrupter with arc chute 122. This indicates that the embodiments of the arc chuteless circuit interrupter 124, 126, and 128 incur less damage due to the effect of overcurrent than does the circuit interrupter with arc chute 122.

Figure 14:
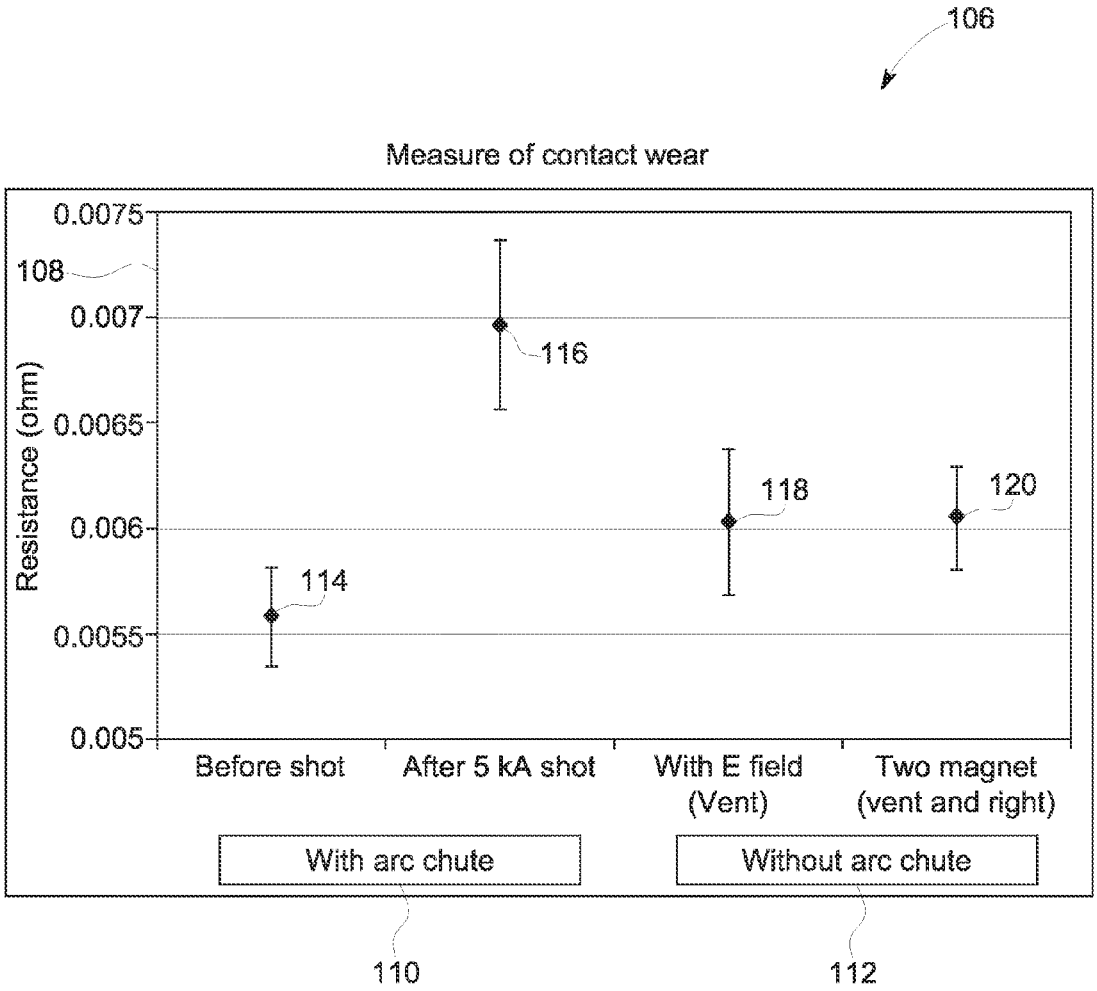
FIG. 14 is a graph comparing the amount of contact wear in systems employing arc chutes and systems employing arc chuteless circuit interrupters according to an embodiment of the present invention.

As mentioned above, a further indication of damage to a circuit interrupter is the amount of contact wear of the contacts 26, 28. FIG. 14 is a graph 106 which compares the amount of contact wear incurred by a circuit interrupter employing arc chutes 110 to that of an arc chuteless circuit interrupter 112. Contact wear may generally be measured by the resistance (ohm) of the contactors. The resistance of the contacts of a circuit interrupter before an over-current event, represented by node 114, is shown to be the lowest, at roughly 0.0056 ohms. The resistance of the contacts of a circuit interrupter using an arc chute, represented by node 116, is the highest, at roughly 0.007 ohms. The resistance of the contactors of an arc chuteless circuit interrupter with an electrode (node 118) and the resistance of the contactors of an arc chuteless circuit interrupter with two permanent magnets (node 120) are both shown to be lower than that of the circuit interrupter employing arc chutes (node 116), at roughly 0.006 ohms and 0.0061 ohms, respectively. It should be noted that all other aspects of the circuit interrupters in this experiment are essentially identical, including detection and tripping mechanisms, size material, and input power parameters. Generally, the only variable is whether the circuit interrupter employs an arc chute 110 or if it is an arc chuteless circuit interrupter 112. According to the graph 106, the arc chuteless circuit interrupter receives less contact wear than the traditional arc chute circuit interrupter. This may be advantageous as this is an indicator of a longer operational life span.

This written description uses examples to disclose the present invention, including the best mode, and also to enable any person skilled in the art to practice the present invention, including making and using any devices or systems and performing any incorporated methods. The patentable scope of the present invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a circuit interrupter configured to interrupt flow of current through a circuit during an over current condition, wherein the circuit interrupter comprises:

two contacts configured to remain in contact when a current flowing through the two contacts is less than a threshold value;

a tripping mechanism configured to separate the two contacts when the current equals or exceeds the threshold value; and at least one of either a permanent magnet or an electrode configured to extinguish an electric arc formed between the two contacts of the circuit interrupter when the two contacts are separated, wherein the circuit interrupter does not include an arc chute.

2. The system of claim 1, wherein the circuit interrupter comprises a permanent magnet configured to generate a magnetic field that disrupts the electric arc.

3. The system of claim 2, wherein the permanent magnet lengthens the electric arc by attracting or deflecting the electric arc.

4. The system of claim 1, wherein the circuit interrupter comprises two permanent magnets, wherein the two permanent magnets are disposed on opposing sides of the electric arc, when present, with opposing poles facing the electric arc, and wherein the two permanent magnets generate a magnetic field that disrupts the electric arc.

5. The system of claim 4, wherein the two permanent magnets lengthen the electric arc by attracting and deflecting the electric arc in a same direction.

6. The system of claim 1, wherein the circuit interrupter further comprises one or more electrodes configured to provide an electric field.

7. The system of claim 6, wherein the electric field lengthens the electric arc by attracting or deflecting the electric arc.

8. The system of claim 7, wherein the one or more electrodes are configured to provide the electric field when the current equals or exceeds the threshold value.

9. The system of claim 1, wherein the tripping mechanism comprises at least one of a bimetallic strip, an electromagnet, and a current sensor.

10. The system of claim 1, wherein the circuit interrupter is further configured to interrupt flow of current in a DC circuit.

11. A system comprising:

a circuit interrupter configured to interrupt flow of current through a circuit during an over current condition, wherein the circuit interrupter does not have an arc chute, the circuit interrupter comprising:

two contacts configured to remain in contact when a current flowing through the two contacts is less than a threshold value;

a tripping mechanism configured to separate the two contacts when the current equals or exceeds the threshold value;

a permanent magnet configured to generate a magnetic field; and an electrode configured to generate an electric field when the two contacts are separated, wherein the magnetic field and the electric field act to extinguish an electric arc formed between two contacts of the circuit interrupter when the two contacts are separated.

12. The system of claim 11, wherein the electrode is configured to generate the electric field when the current equals or exceeds the threshold value.

13. The system of claim 11, wherein the magnetic field and the electric field lengthen the electric arc by attracting and deflecting the electric arc in a same direction.

14. The system of claim 11, wherein the circuit interrupter is configured to interrupt flow of current in a DC circuit.

15. A circuit interrupter configured to interrupt flow of current through a circuit when the current equals or exceeds a threshold value, the circuit interrupter comprising:

two contacts configured to remain in contact when a current flowing through the two contacts is less than a threshold value; and a tripping mechanism configured to separate the two contacts when the current equals or exceeds the threshold value;

wherein the circuit interrupter does not include an arc chute.

16. The circuit interrupter of claim 15, wherein the circuit interrupter is configured to extinguish an electric arc formed between the two contacts of the circuit interrupter.

17. The circuit interrupter of claim 15, wherein the circuit interrupter is configured to interrupt flow of current through a DC circuit.

18. The circuit interrupter of claim 15, wherein the circuit interrupter comprises at least one permanent magnet configured to generate a magnetic field that stretches an electric arc formed between the two contacts of the circuit interrupter when the two contacts are separated.

19. The circuit interrupter of claim 15, wherein the circuit interrupter comprises at least one electrode configured to provide an electric field that stretches an electric arc formed between the two contacts of the circuit interrupter when the two contacts are separated.

20. The circuit interrupter of claim 15, wherein the circuit interrupter comprises a permanent magnet configured to provide a magnetic field and an electrode configured to provide an electric field, wherein the electric field and the magnetic field stretch an electric arc formed between two contacts of the circuit interrupter when the two contacts are separated.

* * * * *

UNITED STATES PATENT AND TRADEMARK OFFICE

CERTIFICATE OF CORRECTION

PATENT NO. : 8,963,662 B2
APPLICATION NO. : 13/781940
DATED : February 24, 2015
INVENTOR(S) : Asokan et al.

It is certified that error appears in the above-identified patent and that said Letters Patent is hereby corrected as shown below:

Specification

In Column 2, Line 48, delete “interrupter; and” and insert -- interrupter; --, therefor.

In Column 3, Lines 60-61, delete “stationary contact 22” and insert -- stationary contact 26 --, therefor.

Signed and Sealed this
Twenty-seventh Day of October, 2015

Michelle K. Lee

Michelle K. Lee
*Director of the United States Patent and Trademark Office*